US005957091A

United States Patent [19]

McDonald et al.

[11] Patent Number: 5,957,091

[45] Date of Patent: Sep. 28, 1999

[54] FULL BODY HARNESS FOR FALL ARREST

[75] Inventors: Kurt D. McDonald; Timothy W. Ecker, both of Thornton, Colo.

[73] Assignee: Rose Manufacturing Company, Englewood, Colo.

[21] Appl. No.: 08/974,132

[22] Filed: Nov. 19, 1997

[51] Int. Cl.[6] ..... A62B 35/00

[52] U.S. Cl. ..... 119/770

[58] Field of Search ..... 119/770; 182/3, 182/4; 224/158, 184; 280/290, 801.1; 297/464, 468, 469, 473, 483, 484

[56] References Cited

U.S. PATENT DOCUMENTS

| | | | |
|---|---|---|---|
| 2,448,066 | 8/1948 | Wilson | 119/770 |
| 2,647,293 | 8/1953 | Wintersorn | 119/770 |
| 3,424,134 | 1/1969 | Rosenblum | 119/770 |
| 4,991,689 | 2/1991 | Cole | 182/3 |
| 5,203,829 | 4/1993 | Fisk et al. | 182/3 |
| 5,433,289 | 7/1995 | O'Rourke | 182/3 |
| 5,531,292 | 7/1996 | Bell . | |
| 5,697,329 | 12/1997 | Bell et al. | 119/857 |

FOREIGN PATENT DOCUMENTS

| | | |
|---|---|---|
| 0 744 192 | 11/1996 | European Pat. Off. . |
| 0 807 451 | 11/1997 | European Pat. Off. . |
| 2 288 532 | 5/1976 | France . |

*Primary Examiner*—Thomas Price
*Attorney, Agent, or Firm*—James G. Uber

[57] ABSTRACT

The present invention provides a full body harness which utilizes a reduced number of components thereby simplifying construction and reducing manufacturing costs. The harness has only four pieces of webbing, two identical shoulder straps and two identical leg straps. These shoulder straps and leg straps are connected to two uniquely designed, multi-functional hip plates. The harness also has a standard back pad and a standard shoulder strap retainer.

20 Claims, 5 Drawing Sheets

FULL BODY HARNESS FOR FALL ARREST

FIELD OF THE INVENTION

The present invention relates to a primary component of a personal fall arrest system namely the harness. The harness, often called a full body harness, is designed to safely support a person being lifted or lowered as well as to sufficiently distribute the fall arrest forces across the wearer's body, thereby reducing injury from a fall if the harness is properly used as part of a fall arrest system.

BACKGROUND OF THE INVENTION

Full body harnesses are widely used for lifting and lowering individuals in dangerous situations and as a primary component in a personal fall arrest system. It can also be used for work positioning, travel restriction, ladder climbing, rescue retrieval and evacuation. While these harnesses are used mainly in an industrial setting, and particularly the construction industry where the likelihood and danger of falls from heights is both numerous and significant, a full body harness can be used in various other applications in which total suspension and support of the body must be ensured, either expectedly or unexpectedly.

Various full body harnesses are shown on page R-4 of the 1997 Rose Catalog. These include the Tradesman™, Vestype™ and Pullover™ Harnesses. Such harnesses typically include adjustable shoulder straps which can be guided in a crossed fashion through a pad formed on a rear part of the harness which is worn on a person's back and is often called a rear pad or back pad. The shoulder straps continue forwardly over the shoulders and adjustably attach via a pair of metal rings called buckles to a seat strap upon which the hindquarters of the wearer can rest and be supported. Two leg straps are adjustably attached to the seat strap at a separate location via a second pair of metal rings to support the legs of the wearer.

The Pullover™ Harness is more particularly shown and described in U.S. Pat. No. 4,712,513. This harness does not require the pre-adjustment of numerous elements to a particular individual but can be adjusted simply and quickly with a single adjustment for practically all sizes of individuals for which the harness is intended.

While all of the above-mentioned harnesses meet the applicable safety requirements, it would be desirable to simplify their construction and lower their manufacturing cost without reducing the quality and versatility of these harnesses.

SUMMARY OF THE INVENTION

Generally, the present invention is a full body harness comprising: a pair of shoulder straps (preferably adjustable); a pair of leg straps (preferably adjustable); a back pad; a shoulder strap retainer (preferably a front pad or a chest strap) and two hip plates; wherein both ends of each shoulder strap are connected to the hip plates and the shoulder straps pass through the back pad (preferably in a crossed manner) and through the shoulder strap retainer; and wherein each leg strap is connected at one end to one of the hip plates and is capable of forming a loop from that hip plate around a wearer's leg and back to the same hip plate. In one embodiment, both ends of each shoulder strap are connected to the same hip plate. In another embodiment, the ends of each shoulder strap are connected to different hip plates.

The present invention provides a unique, versatile and lightweight full body harness which still meets or exceeds most applicable requirements, including ANSI A10.14, CSA and OSHA, while simplifying its construction and lowering its manufacturing costs by reducing the number of components therein. The full body harness of the present invention is uniquely designed to contain the torso of a wearer, position it in an upright position and distribute fall arrest forces to the thighs, chest and shoulders in the event of a fall. Additionally, the full body harness of the present invention can be used with or without the seat strap of current full body harnesses.

Typically, the full body harness of the present invention utilizes only four pieces of webbing, preferably two identical shoulder straps and two identical leg straps. As a result, only two different straps must be manufactured. The present invention also utilizes a standard back pad, a standard shoulder strap retainer such as a front pad or a chest strap, and two unique hip plates or hip buckles. Each hip plate acts to anchor one end of one shoulder strap and one end of one leg strap while acting as an adjustable connection point for the other end of one of the shoulder straps and the other end of one of the leg straps. In one embodiment, both ends of the same shoulder strap are connected to the same hip plate to form a loop. In another embodiment, both ends of one shoulder strap are connected to different hip plates. Preferably, both ends of the same leg strap are connected to the same hip plate to form a loop. Thus, the hip plates perform a variety of functions including anchoring the shoulder straps and the leg straps while providing convenient adjustment for size.

The harness of the present invention is intended to be used in personnel fall arrest systems as well as in work positioning with the addition of optional side D-rings preferably sewn into the shoulder strap just above the hip plate. The harness preferably comes in two models, the over-the-head model (See FIGS. 1–3) and the vest-style model (See FIGS. 4–6), with three sizes in each model, namely, extra small, standard, and extra large. The harness preferably has a back D-ring attached to the back pad for connecting the harness to a fall arrest system. It is designed to weigh less than 2 pounds while having a capacity of one person weighing up to 310 pounds including tools, clothing and other user-borne objects.

Other details and advantages of the present invention will become apparent as the following description of the invention proceeds.

BRIEF DESCRIPTION OF THE DRAWINGS

In the accompanying drawings, preferred embodiments of the present invention and preferred methods of practicing the present invention are illustrated in which.

PRESENTLY PREFERRED EMBODIMENT

Figure 2:
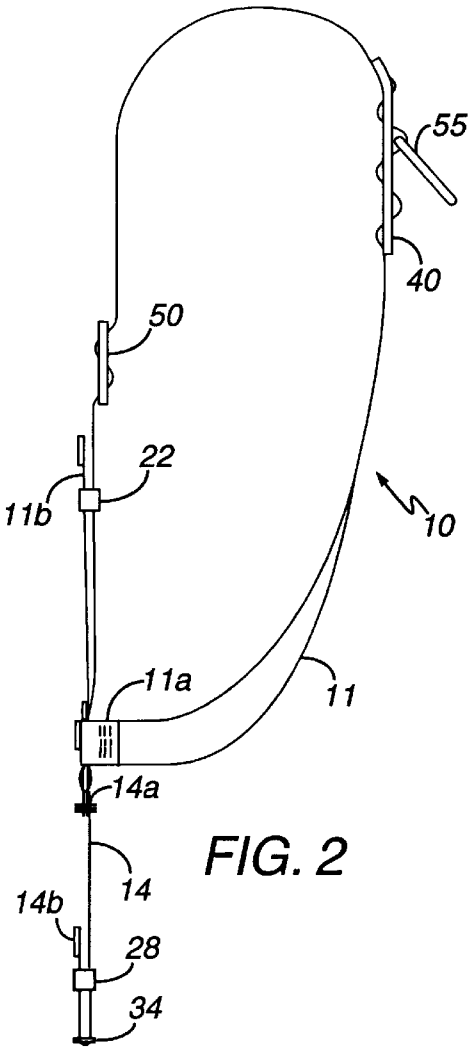
FIG. 2 is a side view of the full body harness of FIG. 1 with the leg straps disconnected from the hip plate.
Figure 1A:
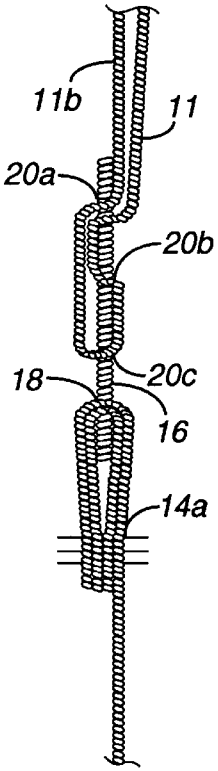
FIG. 1A is a sectional view of the hip plate shown in FIG. 1 taken along line C—C.
Figure 1:
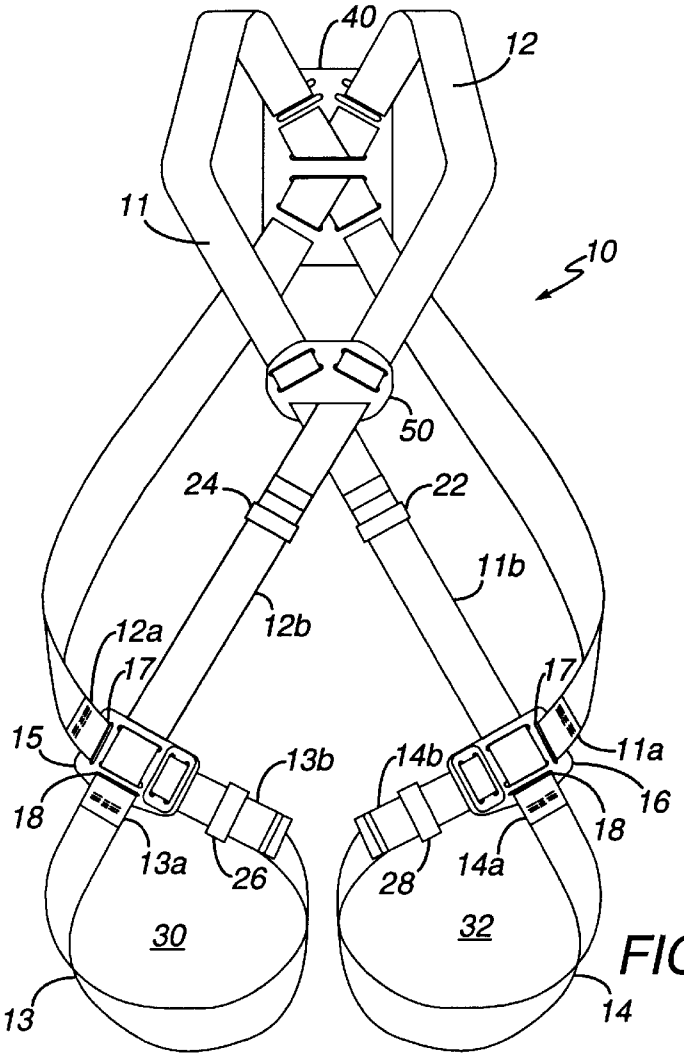
FIG. 1 is a front view of one embodiment of the full body harness of the present invention as it would be worn by a user.
Figure 3:
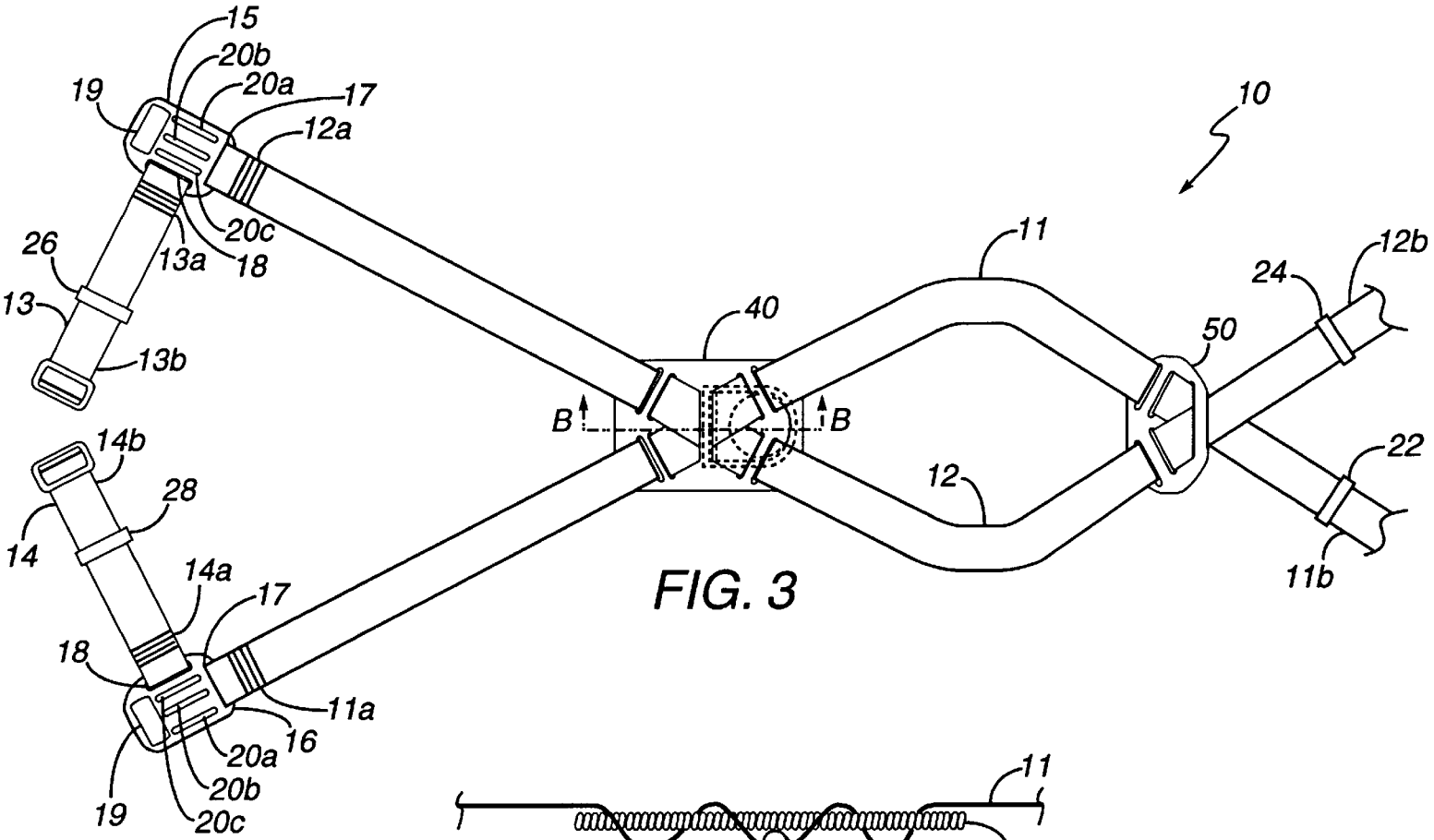
FIG. 3 shows the full body harness of FIG. 1 before the adjustable connections of the shoulder straps and leg straps are made to the hip plates.

FIGS. 1–3 show the over-the-head version of harness 10. There are two shoulder straps 11, 12 preferably identical, and two leg straps 13, 14 preferably identical. Each shoulder strap 11 (12) is attached at one end 11*a* (12*a*) to a hip plate 15 (16). Preferably this attachment is a permanent connection made by passing end 11*a* (12*a*) of shoulder strap 11 (12) through a first slot 17 in hip plate 15 (16) and sewing the end to the shoulder strap 11 (12) to form a closed loop. Similarly, leg strap 13 (14) is attached at one end 13*a* (14*a*) to a hip plate 15 (16). Preferably that attachment is a permanent connection made by passing end 13*a* (14*a*) of leg strap 13 (14) through a second slot 18 in hip plate 15 (16) and sewing the end to the leg strap 13 (14) to form a closed loop.

Figure 7:
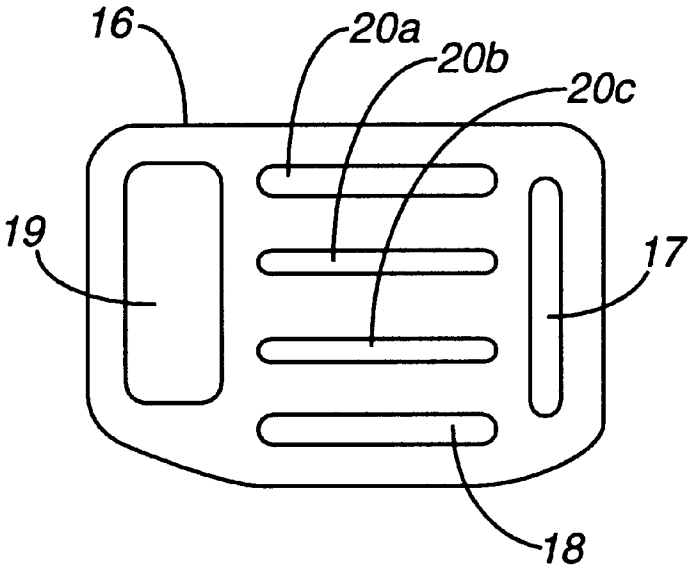
FIG. 7 shows one embodiment of the hip plate of the present invention.

Preferably, shoulder strap 11 (12) forms a loop which begins at hip plate 15 (16) proceeds upwardly across the wearer's back, through back pad 40, preferably in a crossed manner, forwardly over the wearer's shoulders and then downwardly through front pad 50, preferably in a crossed manner, and ending at the same hip plate 15 (16). Preferably this attachment to the hip plate is adjustable so that harness 10 can fit a wide range of people. While various adjustable connections can be used, a presently preferred one is shown in FIGS. 1A and 7 which utilizes a set of three adjacent parallel slots 20*a*, 20*b* and 20*c* the hip plate. Preferably these slots are wide enough to permit the webbing to easily pass therethrough during adjustment while being narrow enough to grip the webbing and prevent slippage when under load. After being threaded through the three parallel slots in hip plate 16 (15), end 11*b* (12*b*) of shoulder strap 11 (12) is inserted through a strap collar 22 (24) located on shoulder strap 11 (12) thereby keeping end 11*b* (12*b*) from dangling and becoming entangled. End 11*b* (12*b*) of shoulder strap 11 (12) is then folded and sewn together to keep it from slipping out of strap collar 22 (24). A similar strap collar 26 (28) is used on leg strap 13 (14).

Similarly, the other end 13*b* (14*b*) of leg strap 13 (14) is attached to the same hip plate 15 (16) to form loop 30 (32). Preferably this attachment to hip plate 15 (16) is adjustable so that harness 10 can fit a wide range of people. While various adjustable connections can be used, a presently preferred one is shown in FIG. 2. This quick-fit leg buckle 34 slips through a third slot 19 in hip plates 15 (16). This third slot 19, as shown in FIG. 7, is larger than first slot 17 or second slot 18 as well as the set of three parallel slots 20*a*, 20*b* and 20*c*.

Figure 8:
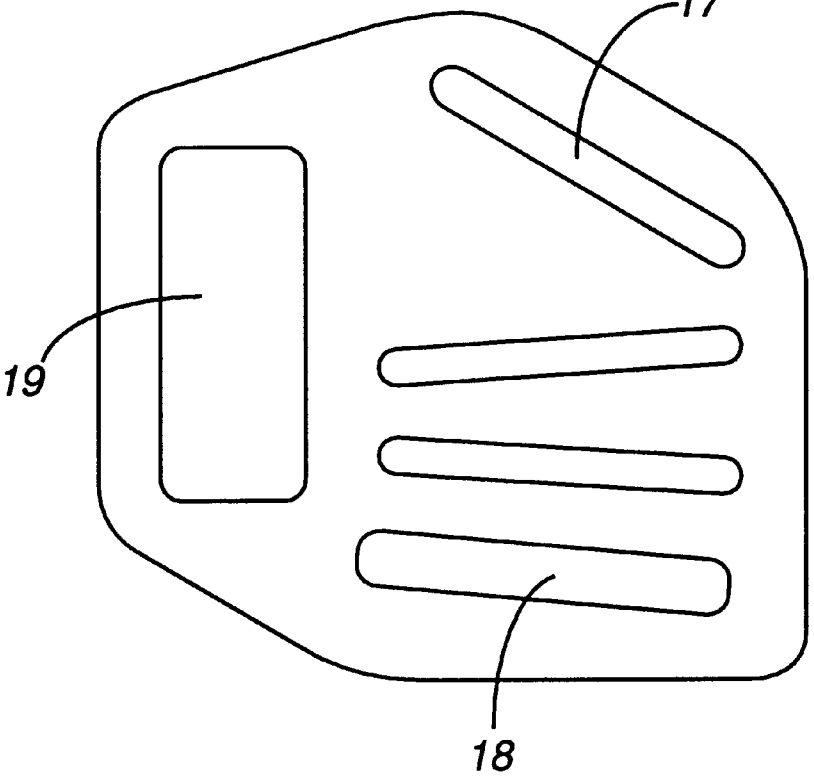
FIG. 8 shows another embodiment of the hip plate of the present invention.

A preferred embodiment of the hip plates 15, 16 is shown in FIG. 7. The hip plates preferably should be forged, stamped, formed, or machined from metal and preferably from high-tensile alloy steel in order to withstand the fall arrest forces. While the number of openings and the arrangement of the openings in the hip plate may vary (See FIG. 8 for another embodiment), there should be enough openings to conveniently and adjustably attach one leg strap and one shoulder strap.

Figure 5:
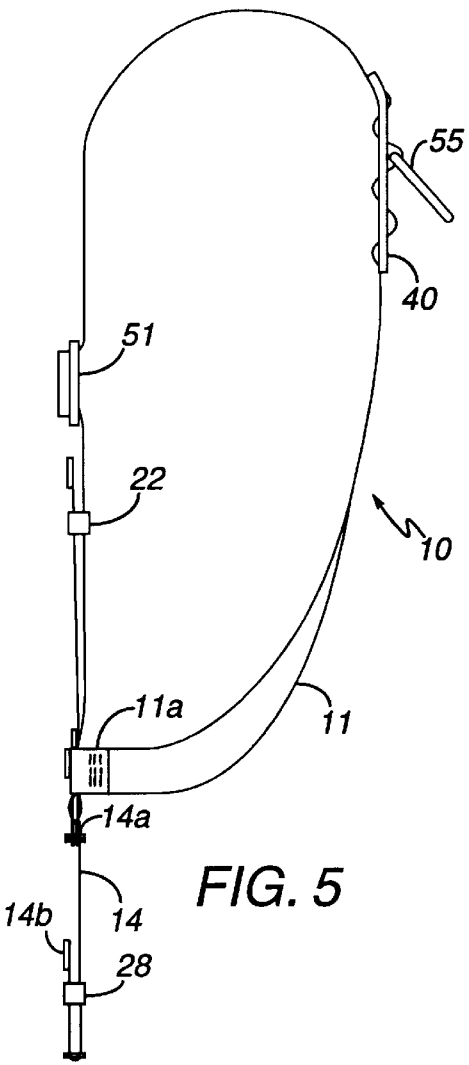
FIG. 5 is a side view of the full body harness of FIG. 4 with the leg straps disconnected from the hip plate.
Figure 4:
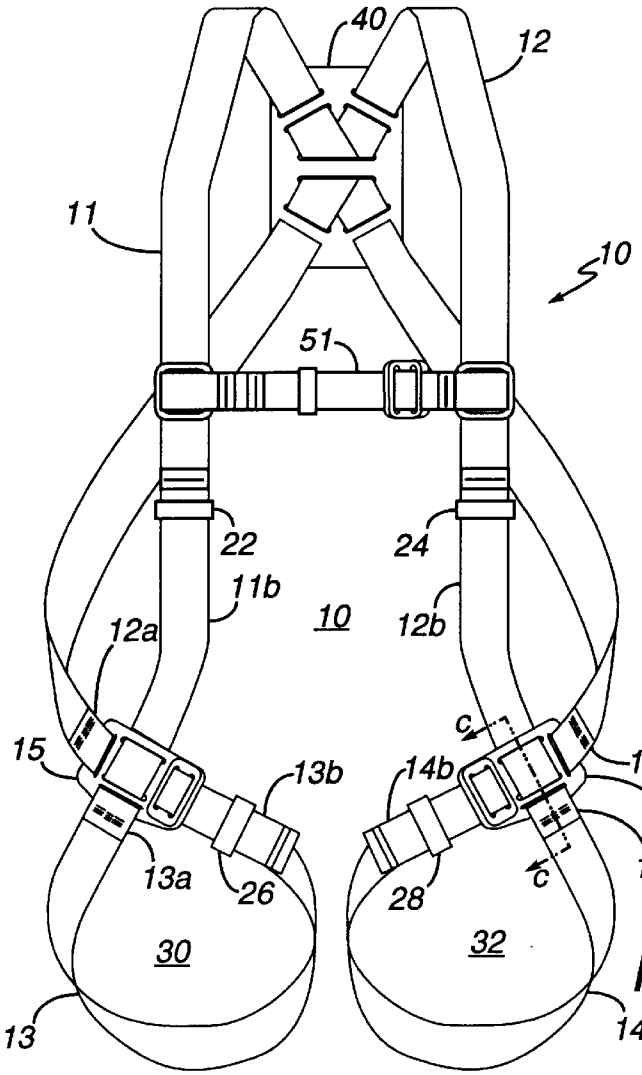
FIG. 4 is a front view of another embodiment of the full body harness of the present invention as it would be worn by a user.
Figure 6:
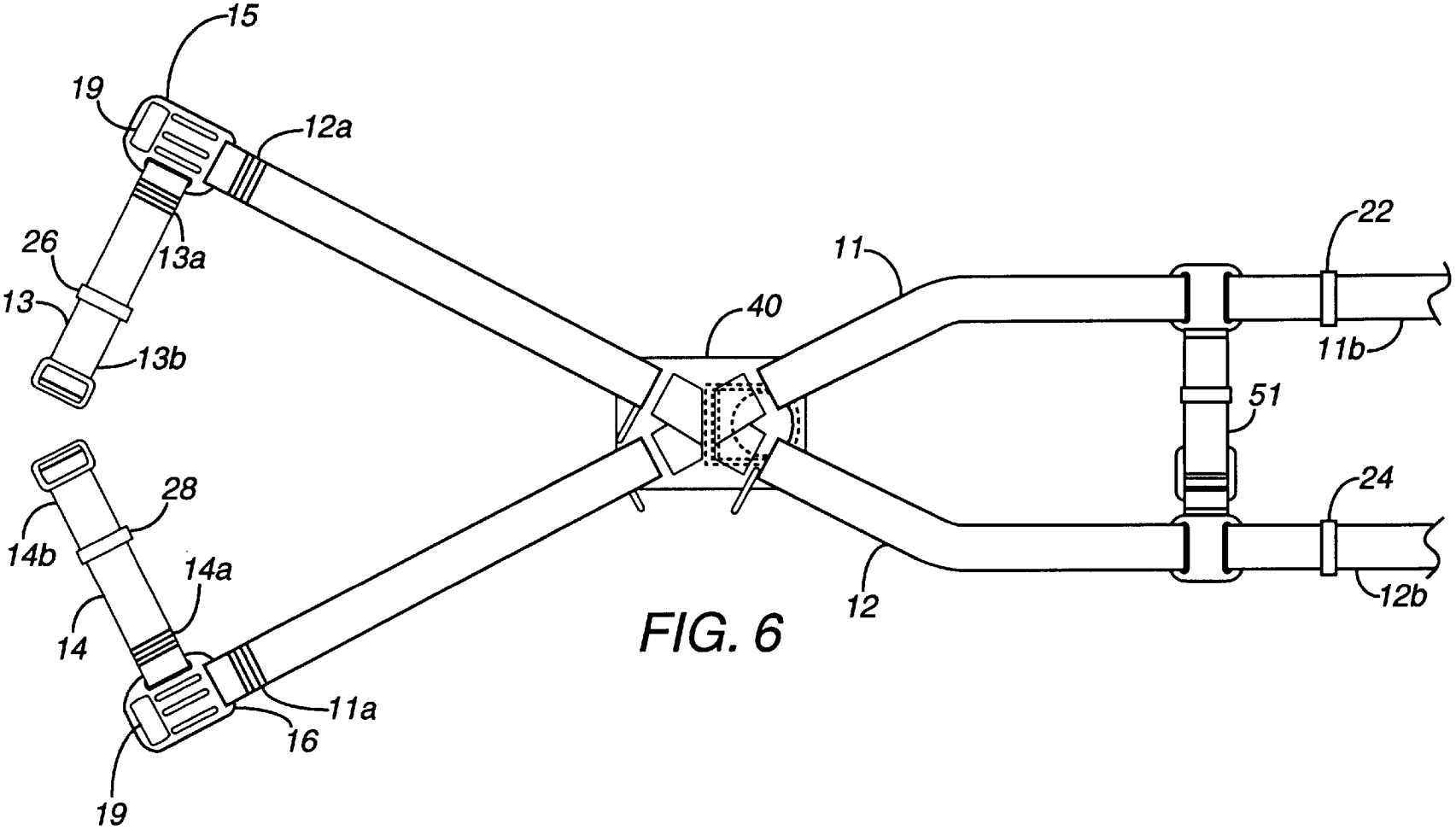
FIG. 6 shows the full body harness of FIG. 4 before the adjustable connections of the shoulder straps and leg straps are made to the hip plates.

FIGS. 4–6 show the vest-style version of harness 10. This version is very similar to the one shown in FIGS. 1–3 except that shoulder strap 11 (12) begins at hip plate 15 (16) proceeds upwardly across the wearer's back and through back pad 40, preferably in a crossed manner, forwardly over the wearer's shoulders and then straight down over the wearer's chest to the opposite hip plate 16 (15). Preferably, it uses a chest strap 51 attached at each end to shoulder straps 11 and 12 as the shoulder strap retainer.

Figure 3A:
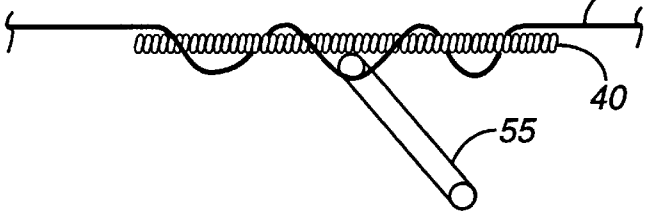
FIG. 3A is a sectional view of the back pad shown in FIG. 3 taken along line B—B.

Preferably harness 10 is made from four pieces of webbing with each shoulder strap 11, 12 being identical and each leg strap 13, 14 being identical. Preferably the webbing is a nylon material having a width of 1.75–2.0 inches, although other materials, such as polyester and Kevlar, as well as other sizes will work. The harness also preferably includes a D-ring 55 which is attached to back pad 40 by shoulder straps 11 (12) as shown in FIG. 3A and serves as a connection point between harness 10 and a personal fall arrest system.

Although the present invention has been described in detail above for the purpose of illustration, it is to be understood that such detail is solely for that purpose and that variations can be made therein by those of ordinary skill in the art without departing from the spirit and scope of the invention as defined by the following claims including all equivalents thereof.

What is claimed is:

1. A body harness comprising: a pair of shoulder straps; a pair of leg straps; a pair of hip plates; a back pad; and a shoulder strap retainer; wherein the shoulder straps are connected at both ends to the hip plates and pass through the back pad and through the shoulder strap retainer; and wherein each leg strap is connected at one end to one of the hip plates and can be connected at the other end to one of the hip plates.

2. The body harness of claim 1 wherein the shoulder strap retainer is a front pad.

3. The body harness of claim 2 wherein the shoulder straps proceed through the back pad in a crossed fashion, proceed through the front pad in a crossed fashion and each shoulder strap is connected at both ends to the same hip plate.

4. The body harness of claim 1 wherein the shoulder strap retainer is a chest strap connected between the shoulder straps.

5. The body harness of claim 4 wherein the shoulder straps proceed through the back pad in a crossed fashion and each end of each shoulder strap is connected to a different hip plate.

6. The body harness of claim 1 wherein each shoulder strap is fixedly connected at one end to one of the hip plates, the other end capable of being adjustably connected to one of the hip plates.

7. The body harness of claim 6 wherein each leg strap is fixedly connected at one end to one of the hip plates, the other end capable of being adjustably connected to the same hip plate.

8. The body harness of claim 1 further comprising a seat strap connected between the hip plates.

9. The body harness of claim 1 wherein each hip plate has a plurality of openings therein.

10. The body harness of claim 9 wherein each hip plate comprises a rectangular-shaped metal disk and the plurality of openings are slots.

11. A body harness comprising: a pair of adjustable shoulder straps; a pair of adjustable leg straps; a pair of hip plates having a plurality of openings therein; a back pad and a front pad; wherein each shoulder strap is anchored at one end to one of the hip plates and adjustably attachable at the other end to the same hip plate thereby forming a loop from the hip plate through the back pad, through the front pad and back to the hip plate; and wherein each leg strap is anchored at one end to one of the hip plates and adjustably attachable at the other end to the same hip plate.

12. The body harness of claim 11 wherein the shoulder straps proceed through the back pad and the front pad in a crossed manner.

13. The body harness of claim 12 wherein the openings are slots.

14. The body harness of claim 13 wherein each hip plate further comprises a rectangular-shaped metal disk.

15. The body harness of claim 12 further comprising a D-ring attached to the back pad by the shoulder straps.

16. A body harness comprising: a pair of adjustable shoulder straps; a pair of adjustable leg straps; a pair of hip plates having a plurality of openings therein; a back pad and a shoulder strap retainer; wherein each shoulder strap is connected to one of the hip plates at one end and adjustably attached to the other hip plate at the other end and each leg strap is connected at one end to one of the hip plates and adjustably attachable at the other end to the same hip plate.

17. The body harness of claim 16 wherein the shoulder strap retainer is a chest strap connected between the shoulder straps.

18. The body harness of claim 16 wherein the shoulder straps proceed through the back pad in a crossed manner.

19. The body harness of claim 16 wherein the openings are slots.

20. The body harness of claim 19 wherein each hip plate further comprise a rectangular-shaped metal disk.

* * * * *